US008658030B2

(12) United States Patent
Osaheni et al.

(10) Patent No.: US 8,658,030 B2
(45) Date of Patent: Feb. 25, 2014

(54) METHOD FOR DEASPHALTING AND EXTRACTING HYDROCARBON OILS

(75) Inventors: John Aibangbee Osaheni, Clifton Park, NY (US); Thomas Joseph Fyvie, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 690 days.

(21) Appl. No.: 12/570,283

(22) Filed: Sep. 30, 2009

(65) Prior Publication Data

US 2011/0073528 A1 Mar. 31, 2011

(51) Int. Cl.
*C10G 21/06* (2006.01)
*C10G 29/12* (2006.01)

(52) U.S. Cl.
USPC ..... 208/324; 208/45; 208/240; 208/244; 208/251 R; 208/253; 208/291; 208/295; 208/309; 208/311; 208/334; 208/339

(58) Field of Classification Search
USPC ..... 208/45, 240, 244, 251 R, 253, 291, 295, 208/309, 252, 311, 322–324, 333, 334, 339
See application file for complete search history.

(56) References Cited

U.S. PATENT DOCUMENTS

| | | | | |
|---|---|---|---|---|
| 3,483,118 | A * | 12/1969 | Gleim et al. | 208/252 |
| 4,039,432 | A * | 8/1977 | Michlmayr | 208/252 |
| 4,170,544 | A * | 10/1979 | Miller | 208/96 |
| 4,303,497 | A * | 12/1981 | Mitchell et al. | 208/422 |
| 5,024,750 | A | 6/1991 | Sughrue, II et al. | |
| 7,279,017 | B2 | 10/2007 | Kresnyak et al. | |
| 7,291,257 | B2 | 11/2007 | Ackerson et al. | |
| 7,341,656 | B1 | 3/2008 | Malone et al. | |
| 7,347,051 | B2 | 3/2008 | Christensen | |
| 7,381,320 | B2 | 6/2008 | Iqbal et al. | |
| 7,390,393 | B2 | 6/2008 | Gueret et al. | |
| 7,419,585 | B2 | 9/2008 | Maa et al. | |
| 7,431,822 | B2 | 10/2008 | Farshid et al. | |
| 7,431,823 | B2 | 10/2008 | Farshid et al. | |
| 7,431,831 | B2 | 10/2008 | Farshid et al. | |
| 7,465,395 | B2 | 12/2008 | Carbonell et al. | |
| 7,507,325 | B2 | 3/2009 | Gueret et al. | |
| 2003/0089637 | A1 | 5/2003 | Gueret et al. | |
| 2003/0089638 | A1 | 5/2003 | Gueret et al. | |
| 2007/0138058 | A1 | 6/2007 | Farshid et al. | |

* cited by examiner

*Primary Examiner* — Walter D Griffin
*Assistant Examiner* — Renee E Robinson
(74) *Attorney, Agent, or Firm* — Ann M. Agosti

(57) ABSTRACT

Provided herein are processes for deasphalting and extracting a hydrocarbon oil. The processes comprise providing an oil comprising asphaltenes and/or other impurities, combining the oil with a polar solvent an extracting agent to provide a mixture, and applying a stimulus to the mixture so that at least a portion of any asphaltenes and/or impurities in the oil precipitate out of the oil.

16 Claims, 4 Drawing Sheets

METHOD FOR DEASPHALTING AND EXTRACTING HYDROCARBON OILS

BACKGROUND

Petroleum is the world's main source of hydrocarbons used as fuel and petrochemical feedstock. Because of the presence of impurities, crude oil is seldom used in the form produced at the well, but rather, is typically converted in oil refineries into the wide range of fuels and petrochemical appropriate for their intended end-use applications.

While compositions of natural petroleum or crude oils vary significantly, all crudes contain sulfur compounds. Generally, sulfur concentrations in crude oils range from about 0.5 to about 1.5 percent, but may deviate upwardly to up to about 8 percent. When combusted, sulfur containing compounds are converted to sulfur oxides (SOx), considered to be an environmental pollutant. Catalytic oxidation of sulfur and the subsequent reaction thereof with water can result in the formation of sulfuric acid mist, thereby also contributing to particulate emissions. And so, such crudes typically must be desulfurized to yield products, which meet performance specifications and/or environmental standards.

Vanadium may also typically be present in crude oils, mainly in the form of porphyrinic and asphaltenic complexes. In some crudes, the vanadium content can reach 1200 ppm and the porphyrinic vanadium content can vary from about 20% to about 50% of the total vanadium content, depending on the source of the crude. The vanadium present in crude has a deleterious effect on the refinery operations, typically by detrimentally impacting the effectiveness of catalysts typically used in catalytic cracking, hydrogenation and hydrodesulphurization. Further, vanadium present in fuel oil combustion products catalyzes the oxidation of sulfur dioxide to sulfur trioxide, leading to the formation of acid rain. Combustion products of vanadium, $V_2O_5$, can adhere to surfaces, leading to corrosion that can be problematic in some applications.

Since asphaltenes tend to form coke and/or consume large quantities of hydrogen, deasphalted oil is typically used as a feedstock into the catalytic cracking process. Conventional processes include the use of propane to deasphalt the crude distillation residues or a resid oil solvent extraction (ROSE) process which utilizes light hydrocarbons chosen from propane, n-butane, and n-pentane. Both of these may also result in the removal of some of the asphaltenic vanadium, nitrogen, and/or sulfur.

However, these conventional processes of deasphalting and demetallization can be suboptimal. For example, both require very large solvent quantities in relation to the hydrocarbon feedstock to be treated, and produce large asphaltene streams. Additionally, their efficiencies and yields may not be satisfactory for some commercial applications. Finally, these conventional processes are typically unable to separate metals that are not totally eliminated with the asphaltene fraction, e.g., vanadium.

Efficient, and more cost effective methods for the removal of asphaltenes and metals, e.g., sulfur and vanadium, from hydrocarbon oils are thus needed.

BRIEF DESCRIPTION

Provided herein are processes for deasphalting and extracting a hydrocarbon oil. The processes comprise providing an oil comprising asphaltenes and/or other impurities, combining the oil with a polar solvent and an extracting agent to provide a mixture, and applying a stimulus to the mixture so that at least a portion of any asphaltenes and/or impurities in the oil precipitate out of the oil.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 2:
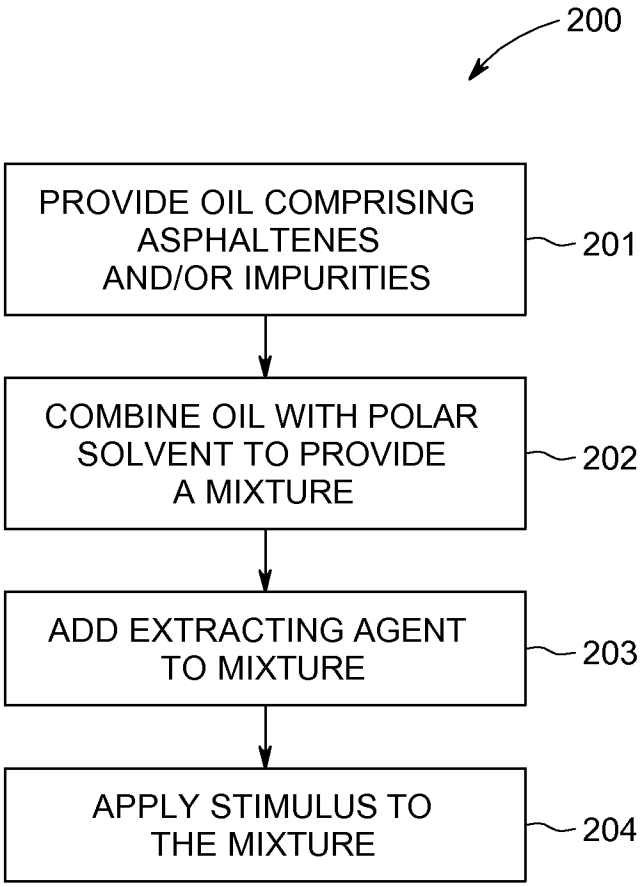
FIG. 2 is a flow chart schematically illustrating another embodiment of the present process.

Unless defined otherwise, technical and scientific terms used herein have the same meaning as is commonly understood by one of skill in the art to which this invention belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced item, and the terms "front", "back", "bottom", and/or "top", unless otherwise noted, are merely used for convenience of description, and are not limited to any one position or spatial orientation. If ranges are disclosed, the endpoints of all ranges directed to the same component or property are inclusive and independently combinable (e.g., ranges of "up to about 25 wt. %, or, more specifically, about 5 wt. % to about 20 wt. %," is inclusive of the endpoints and all intermediate values of the ranges of "about 5 wt. % to about 25 wt. %," etc.). The modifier "about" used in connection with a quantity is inclusive of the stated value and has the meaning dictated by the context (e.g., includes the degree of error associated with measurement of the particular quantity).

Provided herein are processes for deasphalting and extracting a hydrocarbon oil. The processes comprise providing an oil comprising asphaltenes and/or other impurities, combining the oil with a polar solvent and an extraction agent to provide a mixture, and applying a stimulus to the mixture so that at least a portion of any asphaltenes and/or impurities in the oil precipitate out of the oil.

The methods disclosed herein may advantageously be applied to any hydrocarbon oil, or mixture of one or more hydrocarbon oils, comprising asphaltenes and/or other impurities. Exemplary hydrocarbon oils suitable for the present invention include, but are not limited to, liquid oils obtained from bitumen (often called tar sands or oil sands), petroleum, oil shale, coal, as well as synthetic crude oils produced by the liquefaction of coal, heavy crude oils, and petroleum refinery residual oil fractions, such as bottoms or fractions produced by atmospheric and vacuum distillation of crude oil. In some embodiments, heavy fuel oils are utilized in the present methods.

The hydrocarbon oil desirably deasphalted and extracted by the present process is mixed with a polar solvent which does not have appreciable solubility for the oil (e.g. ~<1% of the oil dissolves in the solvent). Any polar solvent may be used, and examples of suitable polar solvents include, but are not limited to dialkyl ether, ethyl ether solution, 2-ethylhexyl vinyl ether, isobornyl methyl ether, 1,2-dichloroethyl ethyl ether, 2-methoxyethanol, 2-ethoxyethanol, 2-methyl-2-propenyl phenyl ether, 3,3-oxydipropionitrile, 2-cyanoethyl ether, acetonitrile, nitromethane, ethanol, methanol, and the like. In some embodiments, an ether may desirably be utilized as the polar solvent, and more particular, in some embodiments, a diethyl ether may be used.

The ratio of the polar solvent to the heavy fuel oil will desirably be sufficient so that the hydrocarbon oil-polar solvent mixture is provided to reduce the initial viscosity of the hydrocarbon oil by about 30-90%. Ratios of polar solvent to the hydrocarbon oil expected to be capable of providing the desired viscosity range from about 0.5:1 to about 10:1, or from about 1:1 to about 2:1. Optionally, the polar solvent utilized may be recovered, in whole or in part, and recycled for this, or other, uses. In embodiments where the same is desired, the polar solvent may be recovered, e.g., via evaporation and subsequent condensation.

Advantageously, an extracting agent is provided to the mixture, and may either be added to the polar solvent prior to mixing with the hydrocarbon oil, or, may be added to the mixture once the polar solvent and hydrocarbon oil have been placed in contact, or both. Suitable extracting agents are desirably substantially soluble in the polar solvent, and substantially insoluble in the hydrocarbon oil. As such, suitable extracting agents may typically facilitate the precipitation of any impurities in the hydrocarbon oil. Examples of suitable extracting agents include Lewis acids, i.e., metal halides such as chlorides, bromides, iodides. In some embodiments, the extracting agent(s) may comprise a metal chloride, such as, e.g., iron (III) chloride.

In order to assist in the precipitation of the asphaltenes and/or impurities from the hydrocarbon oil, a stimulus is desirably applied to the mixture. The stimulus applied may be any stimulus useful for this purpose, and such stimuli are expected to include, e.g, heating, shaking, stirring, vibrating, centrifuging, sonicating, combinations of these and the like. Further, any amount of stimulus may be applied, and effective amounts thereof are readily determined by those of ordinary skill in the art. For efficiencies sake, the amount of stimulus applied may desirably be only that amount necessary to achieve at least some precipitation of asphaltenes and/or impurities out of the hydrocarbon oil, and continuing to apply stimulus beyond the point when no more precipitate appears to be depositing out of the hydrocarbon oil is not typically necessary or useful.

In some embodiments, the mixture is desirably subjected to decanting centrifugation, sonicating, filtering or combinations of these, and in some embodiments, the mixture may be subjected to a period of centrifugation sufficient to result in the precipitation of a substantial portion of any asphaltenes and/or impurities in the hydrocarbon oil.

The present process desirably removes a substantial portion of any asphaltenes and/or impurities within the hydrocarbon oil prior to application of the method. Asphaltenes are molecular substances that are found in crude oil, and consist primarily of carbon, hydrogen, nitrogen, oxygen, and sulfur, as well as trace amounts of vanadium and nickel. The C:H ratio is approximately 1:1.2, depending on the asphaltene source. Asphaltenes are defined operationally as the n-heptane ($C_7H_{16}$)-insoluble, toluene ($C_6H_5CH_3$)-soluble component of a carbonaceous material such as crude oil, bitumen or coal. Asphaltenes have been shown to have a distribution of molecular masses in the range of 400μ to 1500μ with a maximum around 750μ.

The present process advantageously also removes at least a portion of any other impurities in the hydrocarbon oil. The particular impurities and concentration(s) thereof, in the hydrocarbon oil may be dependent on the geographical source of the hydrocarbon oil, as well as the form and prior processing (if any) of the hydrocarbon oil. Typically, such impurities may include those comprising nickel, sulfur and/or vanadium, i.e., the impurities may comprise any ions, salts, complexes, and/or compounds including nickel, vanadium, and sulfur. Examples of impurities comprising vanadium that may be removed by the present method include, but are not limited to vanadium porphyrins and oxides, such as for example, vanadium pentoxide. Examples of impurities comprising nickel include nickel porphyrins, salts etc.

In one embodiment, the impurities comprise organic sulfur-containing compounds, such as alkyl sulfides or aromatic sulfur containing compounds. Such embodiments are particularly advantageous, since conventional methods are not capable of co-removal of both asphaltenes and sulfur impurities. Examples of organic sulfur-containing compounds that may typically contaminate hydrocarbon oils, and that are desirably removed therefrom, include thiophene and its derivatives. Exemplary derivatives of thiophene include various substituted benzothiophenes, dibenzothiophenes, phenanthrothiophenes, benzonapthothiophenes, thiophene sulfides, and the like. In some embodiments, the initial sulfur content of the hydrocarbon oil is reduced by the present process by at least about 50%, or even by at least about 75%, or even at least about 90%.

Advantageously, added or removing heat and pressure are not necessary for carrying out the present process. However, application of either or both may facilitate the precipitation of any asphaltenes and/or other impurities within the hydrocarbon oil, and so, the present process may optionally include the same. If so desired, the hydrocarbon oil, polar solvent, and/or mixture may be provided with a temperature at which the solvent does not freeze, typically a temperature of at least about 10° C., or from about 20° C. to about 50° C., or even from about 20° C. to about 35° C. The hydrocarbon oil, polar solvent, and/or mixture may also be provided with a pressure of at least about 1 atmosphere, or from about 1 atmosphere to about 5 atmospheres, or even from about 1 atmosphere to about 2 atmospheres.

The asphaltenes and/or impurities so precipitated from the hydrocarbon oil may then be removed from the hydrocarbon oil. Although the mixture is expected to be capable of separating on its own, the separation of the mixture into the liquid hydrocarbon oil phase, and the solid asphaltene/impurity phase may be promoted by application of one or more stimuli, as discussed above.

After separation, the layers may be separated by any suitable extraction method or apparatus known in the art, such as by decantation, in a batch process via a separatory funnel, by continuous decantation, or continuous centrifugation, as known in the art. Thereafter, the hydrocarbon oil treated by the disclosed process may be delivered to a point-of-use, or, may be subjected to further processing, or to be re-treated via one or more steps of the disclosed process. For example, the polar solvent may be removed from the bottom phase along with the asphaltenes, and further separated by evaporation and condensation and recycled either for use in the present process, or downstream processes. Or, the hydrocarbon oil may be retreated by all or a portion of the present process. As would be appreciated by one skilled in the art, the number of times the process is performed can be dependent on the desired purity of the final hydrocarbon product, and one or more of the contacting steps can be repeated until the desired purity has been substantially achieved.

The present process is expected to be less costly and complicated than conventional processes for the removal of asphaltenes and/or impurities from hydrocarbon oils, such as for example, hydrodesulfurization, hydrodemetallization, or metallization processes. Further, the present process makes use of materials that are readily available in bulk quantities. And, the present process is expected to be capable of removing at least similar quantities, and desirably greater quantities, of asphaltenes and/or impurities than such conventional techniques.

For example, the disclosed process is capable of removing all of the measurable levels of asphaltenes. Further, the process is desirably capable of removing substantially all of the sulfur impurities from a hydrocarbon oil (e.g. to a level of less than about 1% by weight) from a hydrocarbon oil having greater than 3% sulfur content. This is particularly advantageous as conventional methods for deasphalting hydrocarbon oils cannot also remove sulfur impurities, or at least cannot remove sulfur impurities from a level of greater than about 3%, to levels of less than 1% by weight. Aspects of the present invention are particularly useful for gas turbine applications where it is often desirable to lower the sulfur impurity content from 4% by weight sulfur (or greater) to less than about 1% by weight sulfur. The present process is also capable of removing substantially all of the impurities comprising vanadium from a hydrocarbon oil (e.g. to a level of less than about 10 ppm or in some embodiments less than about 1 ppm by weight of vanadium) from a hydrocarbon oil having greater than about 1200 ppm vanadium content.

Figure 1:
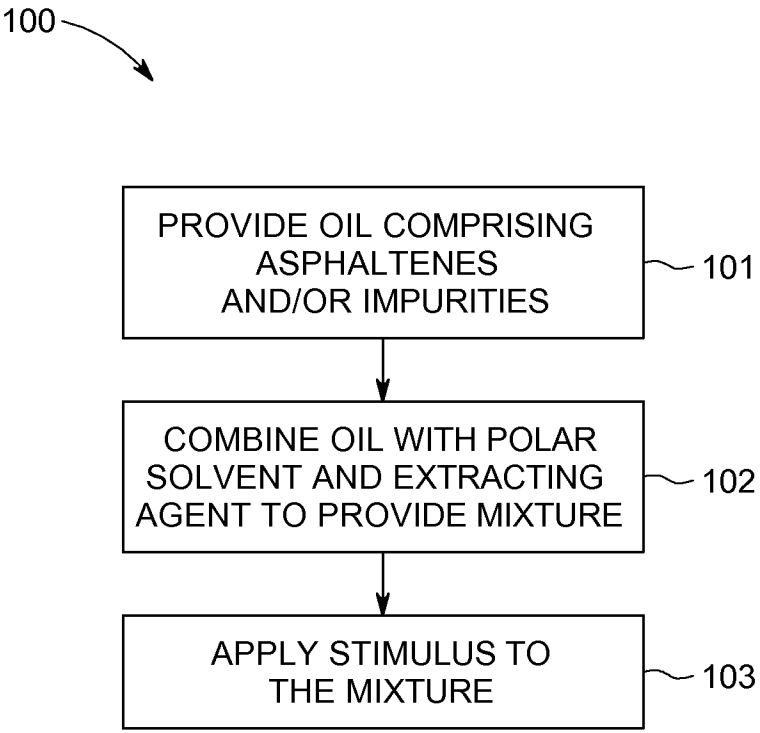
FIG. 1 is a flow chart schematically illustrating one embodiment of the present process.

Referring now to FIG. 1, one embodiment of the disclosed process for removing asphaltenes and/or impurities from a hydrocarbon oil is shown in flow chart form. More specifically, FIG. 1 shows process 100, wherein a hydrocarbon oil comprising asphaltenes and/or other step impurities is provided at 101. The impurities capable of being removed by process 100 include one or more of asphaltenes, sulfur, and/or vanadium impurities and molecules containing sulfur, vanadium and nickel.

The hydrocarbon oil is combined with a polar solvent and extracting agent as shown at step 102. The polar solvent may comprise any appropriate polar solvent in which the desired extracting agent is soluble, and so can depend on the selection of the same. Typically, extracting agents capable of facilitating the precipitation of, e.g., impurities comprising sulfur and vanadium, may include those comprising Lewis acids and polar solvents in which these are soluble include dialkyl ether, ethyl ether solution, 2-ethylhexyl vinyl ether, isobornyl methyl ether, 1,2-dichloroethyl ethyl ether, 2-methoxyethanol, 2-ethoxyethanol, 2-methyl-2-propenyl phenyl ether, 3,'3-oxydipropionitrile, 2-cyanoethyl ether, acetonitrile, nitromethane, ethanol, methanol. The ratio of the polar solvent to the hydrocarbon oil may be from about 0.5:1 to about 10:1, or from about 1:1 to about 2:1.

The hydrocarbon oil/polar solvent/extracting agent mixture has a stimulus applied thereto at step 103. Any stimulus may be utilized that facilitates the precipitation of impurities from the hydrocarbon oil, including, e.g., heat, shaking stirring, vibrating, centrifuging, sonicating, filtering or combinations thereof. Of these, centrifuging and/or sonication may be used in certain embodiments. For example, centrifugation at least about 500 rpm, or 2500 rpm or higher, for at least about 1 minute, or 20 minutes, may be sufficient to assist in the precipitation of impurities from the hydrocarbon oil.

Another embodiment of the present process is shown in FIG. 2. As shown in FIG. 2, the extracting agent may be added to a mixture comprising the hydrocarbon oil and the polar solvent. More particularly, process 200 comprises providing a hydrocarbon oil having asphaltenes and/or other impurities desirably removed therefrom at step 201. At step 202, the hydrocarbon oil is combined with a polar solvent to provide a mixture, and the extracting agent added thereafter, at step 203. The desired stimulus is then applied at step 204.

Figure 3:
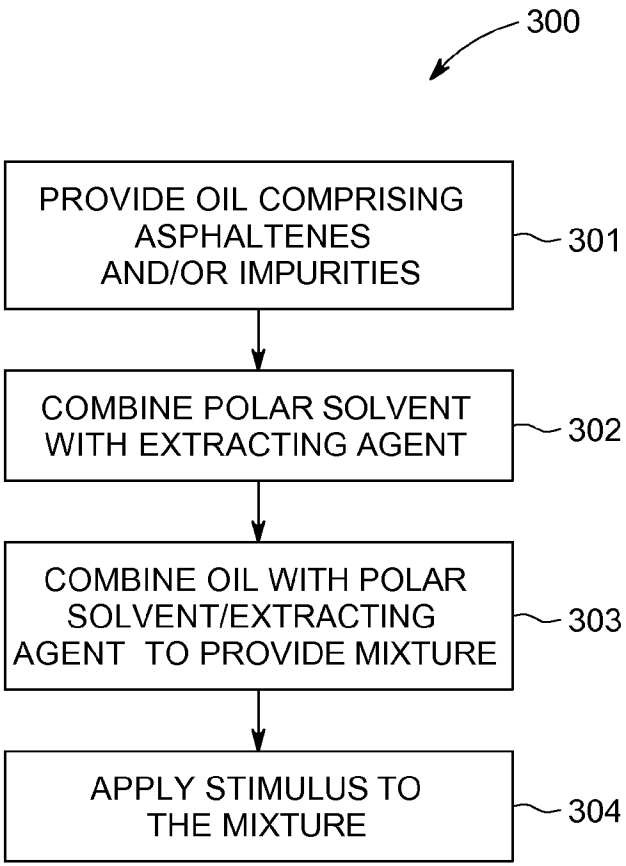
FIG. 3 is a flow chart schematically illustrating another embodiment of the present process.

Or, as shown in FIG. 3, the extracting agent may be combined with the polar solvent prior to mixing the same with the hydrocarbon oil. Process 300 comprises providing the hydrocarbon oil desirably subjected to the present method at step 301. At step 302, the desired polar solvent is mixed with the desired extracting agent. Then, at step 303, the hydrocarbon oil is combined with the polar solvent/extracting agent, to provide a mixture. The desired stimulus is applied to the mixture at step 304.

Figure 4:
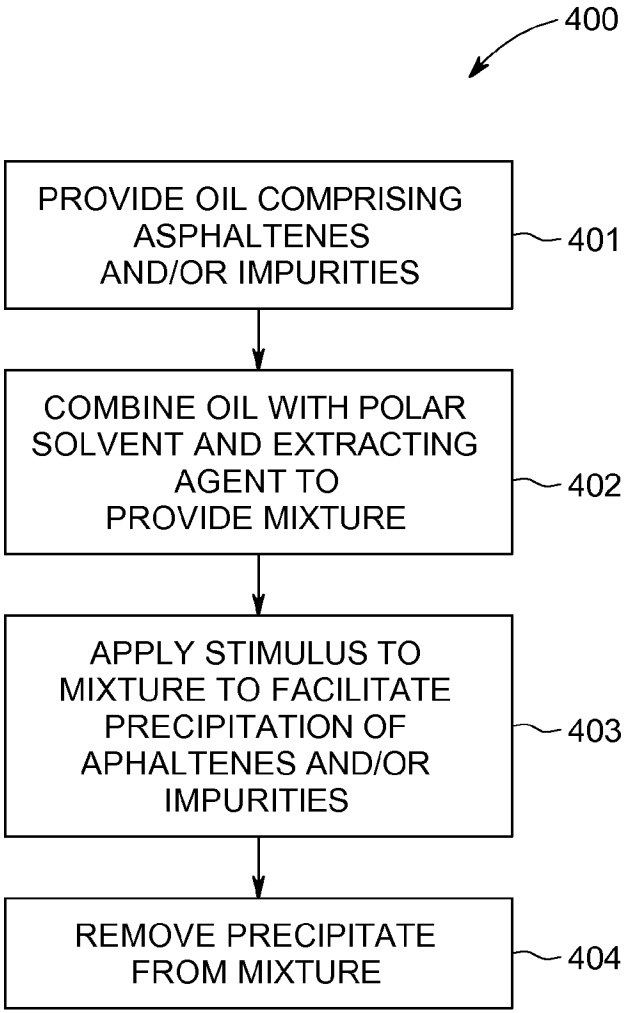
FIG. 4 is a flow chart schematically illustrating another embodiment of the present process.

The present process may also comprise removing the precipitated asphaltenes and/or impurities from a mixture, as shown in FIG. 4. More particular, and as shown in FIG. 4, process 400 comprises providing hydrocarbon oil desirably subjected to the present process at step 401. The hydrocarbon oil is combined with the desired polar solvent and extracting agent to provide a mixture at step 402. A stimulus is then applied to the mixture at step 403, and results in at least a portion of the asphaltenes and/or impurities within the hydrocarbon oil precipitating out of the mixture. The precipitate may then be removed from the mixture as shown at step 404, e.g., by centrifuging and then decanting, etc. the mixture from the precipitate.

Figure 5:
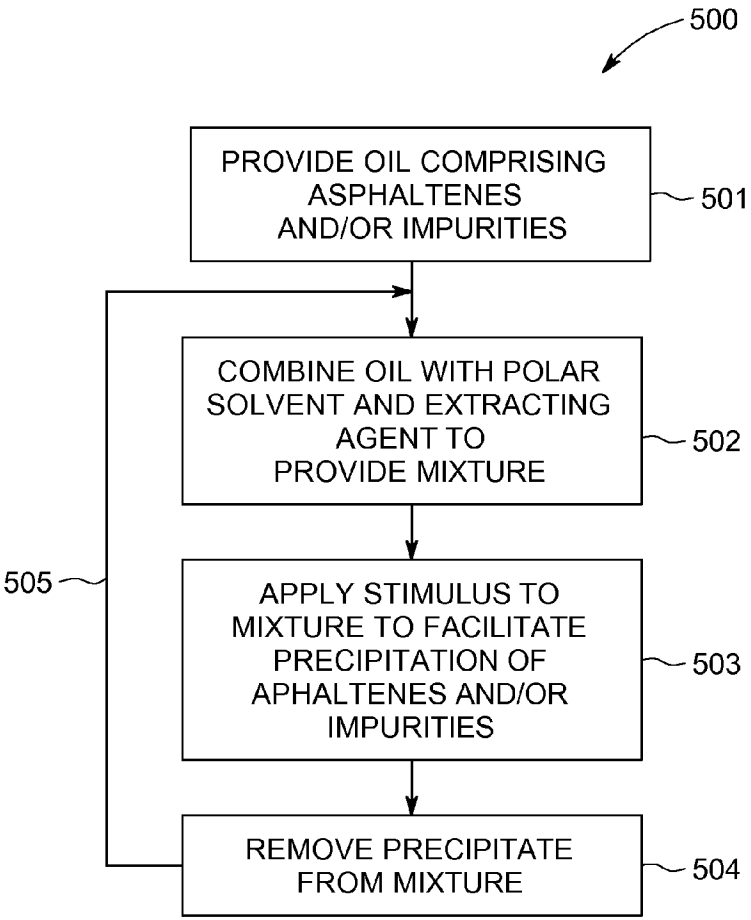
FIG. 5 is a flow chart schematically illustrating another embodiment of the present process.

In some embodiments, it may be desirable to repeat either or both of the addition step and/or the step of applying stimulus to the mixture. Repetition of one or both of these steps can further reduce the amount of asphaltenes and/or impurities in the hydrocarbon oil so that more pure fractions may be obtained, or cruder grades of hydrocarbon oils may be started with. One such embodiment is shown in FIG. 5, wherein once the precipitate is removed at step 504, the mixture is recycled through the process at step 505, i.e., the mixture is subjected to both an additional step of combining the mixture with a further amount of polar solvent and extracting agent at repeated step 502 and application of stimulus at repeated step 503.

Figure 6:
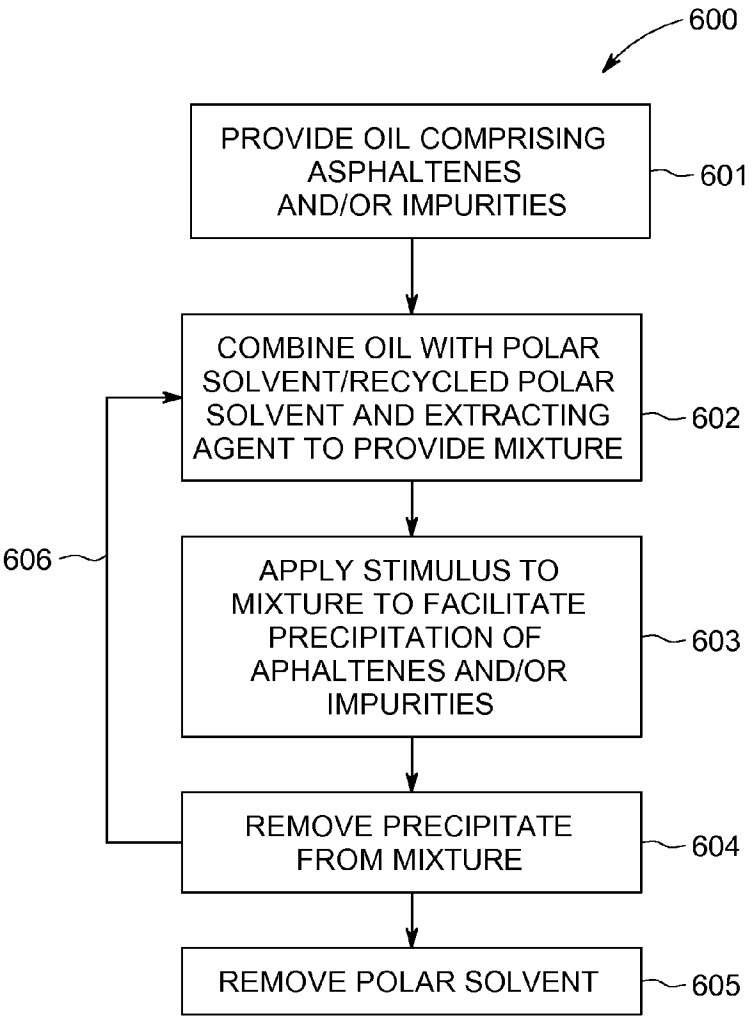
FIG. 6 is a flow chart schematically illustrating another embodiment of the present process.

Or, once the precipitate is removed from the mixture (step 604 in process 600), the polar solvent may also be removed therefrom (step 605), e.g., as by evaporation, and reused in the process as shown in FIG. 6. As shown, process 600 involves providing a hydrocarbon oil comprising asphaltenes and/or impurities at step 601, and combining the hydrocarbon oil with a polar solvent/recycled polar solvent and extracting agent at step 602. A stimulus is then applied to the mixture at step 603 to facilitate precipitation of asphaltenes and impurities from the mixture, and the precipitate removed at step 604. The polar solvent may then be removed from the mixture at step 605, and the recovered polar solvent recycled back to the process at step 606.

Figure 7:
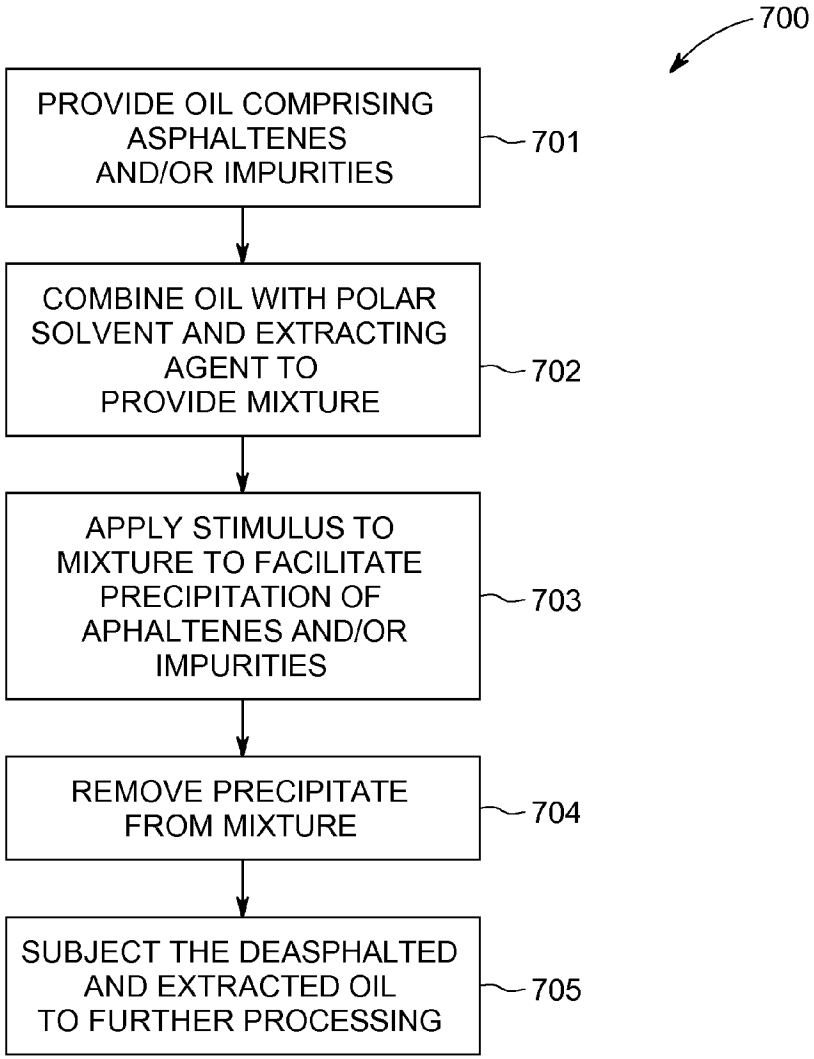
FIG. 7 is a flow chart schematically illustrating another embodiment of the present process.

The present process desirably results in the provision of hydrocarbon oil substantially free of asphaltenes and/or other impurities and ready for further processing, and the same is contemplated and is shown at FIG. 7. That is, process 700 comprises providing hydrocarbon oil comprising asphaltenes and impurities at step 701, and combining the hydrocarbon oil with a polar solvent and extracting agent to provide a mixture at step 702. A stimulus is then applied to the mixture at step 703, resulting in the precipitation of at least a portion of any asphaltenes and/or impurities in the hydrocarbon oil. The precipitated asphaltenes and/or impurities may then be removed from the mixture as shown at step 704, and the hydrocarbon oil subjected to further processing as shown at step 705.

EXAMPLES

Control: 2.77 g Heavy Fuel oil (HFO) from Saudi was weighed into a centrifuge tube. 4.31 g of diethyl ether (polar solvent) was added. The tube was shaken vigorously until the contents were well mixed and the oil "dissolved" in the diethyl ether. The resulting mixture was centrifuged at 2100 rpm for 10 minutes. The residual diethyl ether in the cake at the bottom of the tube as well as the supernatant was dried off at room temperature to constant weight. The residue removed was 18.7 wt %. The sulfur in diethyl ether-free supernatant was measured by X-ray Fluorescence (XRF) and was found to be 3.5 wt % sulfur. The residual sulfur content is similar to what is obtained when petroleum ether is used to de-asphalt, i.e. this conventional process does not remove sulfur compounds from the HFO to any appreciable extent.

Example 1

To a 15 ml centrifuge tube was weighed 0.39 g of iron (III) chloride. 6 g of diethyl ether (DEE) was added to dissolve the $FeCl_3$. This solution becomes a solvent for deasphalting and S- and V-targeting agent. 3.52 g of HFO was added. The mixture was vigorously shaken until the HFO appear to "dissolve" completely in the DEE/$FeCl_3$ solution. The resulting mixture was centrifuged at 2100 rpm for 10 minutes. The residual diethyl ether in the supernatant was dried off at room temperature to constant weight before % S measurement was done by XRF. Total supernatant recovered was ~78% of the starting oil and the residual sulfur was 2.35 wt. %.

Example 2

To a 50 ml centrifuge tube was weighed 5.0 g of iron (III) chloride. 10 g of diethyl ether was added to dissolve the $FeCl_3$. This solution becomes a solvent for deasphalting and S- and V-targeting agent. 10.0 g of HFO was added. The mixture was vigorously shaken until the HFO appear to "dissolve" completely in the DEE/$FeCl_3$ solution. The resulting mixture was centrifuged at 2100 rpm for 10 minutes. The residual diethyl ether in the supernatant was dried off at room temperature to constant weight before % S measurement was done by XRF. The residual sulfur was 1.67 wt. %.

While various embodiments of the present invention have been shown and described herein, it will be understood that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

The invention claimed is:

1. A process for deasphalting and extracting a hydrocarbon oil comprising providing an oil comprising sulfur and/or vanadium, combining the oil with a solvent consisting essentially of diethyl ether and a Lewis Acid to provide a mixture, and applying a stimulus to the mixture so that at least a portion of the sulfur and/or vanadium in the oil precipitates out of the oil.

2. The process of claim 1, wherein the ratio of diethyl ether to oil is from about 0.5:1 to about 10:1.

3. The process of claim 2, wherein the ratio of diethyl ether to oil is from about 1:1 to about 2:1.

4. The process of claim 1, wherein the Lewis acid comprises a metal chloride.

5. The process of claim 4, wherein the Lewis acid comprises iron (III) chloride.

6. The process of claim 1, wherein the stimulus comprises heating, cooling, shaking, stirring, vibrating, centrifuging, sonicating, filtering or combinations of these.

7. The process of claim 1, wherein the stimulus comprises centrifuging, decanting, sonicating, or a combination thereof.

8. The process of claim 7, wherein the stimulus comprises centrifuging.

9. The process of claim 1, wherein the process reduces the initial vanadium content.

10. The process of claim 1, wherein the process reduces the initial sulfur content of the hydrocarbon oil by at least about 50%.

11. The process of claim 10, wherein the process reduces the initial sulfur content of the hydrocarbon oil by at least about 75%.

12. The process of claim 11, wherein the process reduces the initial sulfur content of the hydrocarbon oil by at least about 90%.

13. The process of claim 1, further comprising removing the precipitate from the mixture.

14. The process of claim 13, further comprising evaporating the diethyl ether.

15. The process of claim 14, wherein the diethyl ether is recycled.

16. The process of claim 1 wherein no heat is added or removed while combining the oil with the solvent and applying the stimulus.

* * * * *